US006283342B1

(12) United States Patent
Wilkerson

(10) Patent No.: US 6,283,342 B1
(45) Date of Patent: Sep. 4, 2001

(54) FOOTWEAR DONNING ASSISTANCE DEVICE

(76) Inventor: Melvin T. Wilkerson, 4336 Third Ave. South, Minneapolis, MN (US) 55407

( * ) Notice: Subject to any disclaimer, the term of this patent is extended or adjusted under 35 U.S.C. 154(b) by 0 days.

(21) Appl. No.: 09/585,048

(22) Filed: Jun. 1, 2000

Related U.S. Application Data

(60) Provisional application No. 60/137,878, filed on Jun. 7, 1999.

(51) Int. Cl.[7] ..... A47G 23/90
(52) U.S. Cl. ..... 223/112; 223/111
(58) Field of Search ..... 223/111, 112, 223/113, 114, 120

(56) References Cited

U.S. PATENT DOCUMENTS

| | | | | |
|---|---|---|---|---|
| D. 245,204 | | 7/1977 | Walter | D2/378.1 |
| 1,766,374 | | 6/1930 | Byrd . | |
| 3,396,883 | | 8/1968 | Batista . | |
| 3,501,073 | | 3/1970 | Breithor . | |
| 3,692,217 | * | 9/1972 | Smith | 223/111 |
| 3,860,156 | | 1/1975 | Lawrence | 223/111 |
| 4,238,061 | * | 12/1980 | Marchetti | 223/111 |
| 4,355,745 | | 10/1982 | Nelson | 223/118 |
| 4,637,533 | * | 1/1987 | Black | 223/114 |
| 5,687,889 | * | 11/1997 | Liden | 223/111 |
| 5,806,729 | | 9/1998 | Ramon | 223/113 |
| 5,909,831 | * | 6/1999 | Griffin | 223/112 |
| 5,974,701 | | 11/1999 | Busch | 223/113 |
| 6,056,171 | * | 5/2000 | Santamaia | 223/112 |

* cited by examiner

*Primary Examiner*—Bibhu Mohanty
(74) *Attorney, Agent, or Firm*—Peterson, Thuente, Skaar & Christensen, P.A.

(57) ABSTRACT

A footwear donning assistance device is provided. The footwear donning assistance device includes a handle or looped web and an insertion member. The insertion member is made from resilient materials and includes a central element and two wing elements. The central member and wing elements prevent the footwear piece from being folded or rolling inwardly when being donned. An upper portion of the central element is concavely shaped to guide the user's heel into the shoe. The wing elements may be flared to guide the user's foot and to prevent adjacent portions of the shoe from being folded or rolled when being donned.

21 Claims, 7 Drawing Sheets

FOOTWEAR DONNING ASSISTANCE DEVICE

CROSS-REFERENCES TO RELATED APPLICATIONS

This application claims priority under 35 U.S.C. § 119(e) to, and hereby incorporates by reference, U.S. Provisional Application No. 60/137,878, filed Jun. 7, 1999.

BACKGROUND OF THE INVENTION

1. Field of the Invention

The present invention relates to aids for physically challenged persons and, in particular, the present invention relates to a device to aid physically challenged persons when donning footwear.

2. Background of the Invention

Physically challenged persons frequently encounter difficulty when attempting to don footwear. Such persons may be physically challenged due to limited bending, reaching, or gripping ability, lack of coordination, or other impediments. These, or other disabilities, often occur subsequent to onset of strokes, spinal chord injuries, arthritis, or surgeries such as for hip or knee replacement. Devices such as shoe spoons have long been known, but may be nonetheless of limited utility to these physically challenged persons. There is then a need for a device to assist persons in donning footwear. There is a particular need for a device to easily, readily, and simply provide assistance to persons donning footwear.

SUMMARY OF THE INVENTION

The present invention substantially meets the aforementioned needs by providing a device to assist persons when donning footwear. The device may include means for grasping the device and an insertion member. The insertion member may include a resilient, substantially flexible central member, a plurality of guides, and a connecting member. The central member may be dimensioned to be accommodated by a footwear opening in footwear such as a shoe, the footwear opening accommodating insertion of a person's foot. The central member may be generally arcuate in cross-section and may define a generally central cavity. The central member may further include a first and second end. The first and second ends may be conformed to being spaced apart, thereby defining a gap. The plurality of guides may be disposed on the flexible member proximate the gap. The connecting member may be in mechanical communication with the central member and with the device grasping means.

The present invention provides a footwear donning assistance device, which includes a substantially resilient positioning member and a substantially resilient insertion member. The insertion member may be generally C-shaped in cross-section and may be attached to the positioning member. The insertion member may include a central element and first and second wing elements. The wing elements may extend generally transversely from the central element to define a channel. The wing elements may be spaced apart to accommodate a user's foot therebetween and to spread the footwear proximate the footwear opening and prevent the footwear from being folded or rolled by the user's foot when the footwear is being donned. Upper portions of the wing elements may be flared outwardly to further guide the user's foot into channel.

One advantage of the present footwear donning assistance is that the handle allows footwear to be donned without requiring the user to bend or stoop.

Another advantage of the present footwear donning device is that the sides of the footwear are held out of the way by the insertion member and are thus prevented from being rolled or folded inwardly when the footwear is being donned.

Yet another advantage of the present footwear donning device is that the notch and contours of the insertion member lower rim allow the insertion member to be tilted rearwardly without tilting the footwear when the footwear is being donned.

Still another advantage of the present footwear donning device is that the outwardly flared portions of the insertion member help guide the user's foot into the insertion device when a piece of footwear is being donned.

Yet still another advantage of the present footwear donning assistance device is that the concave upper extension guides the user's heel into the shoe heel when a piece of footwear is being donned.

Additional objects, advantages, and features of various embodiments of the invention will be set forth in part in the description which follows, and will become apparent to those skilled in the art upon examination of the following or may be learned by practice of the invention. The objects and advantages of various embodiments of the invention may further be realized and attained by means of the instrumentalities and combinations particularly pointed out in the appended claims.

DETAILED DESCRIPTION OF THE PREFERRED EMBODIMENTS

Figure 1:
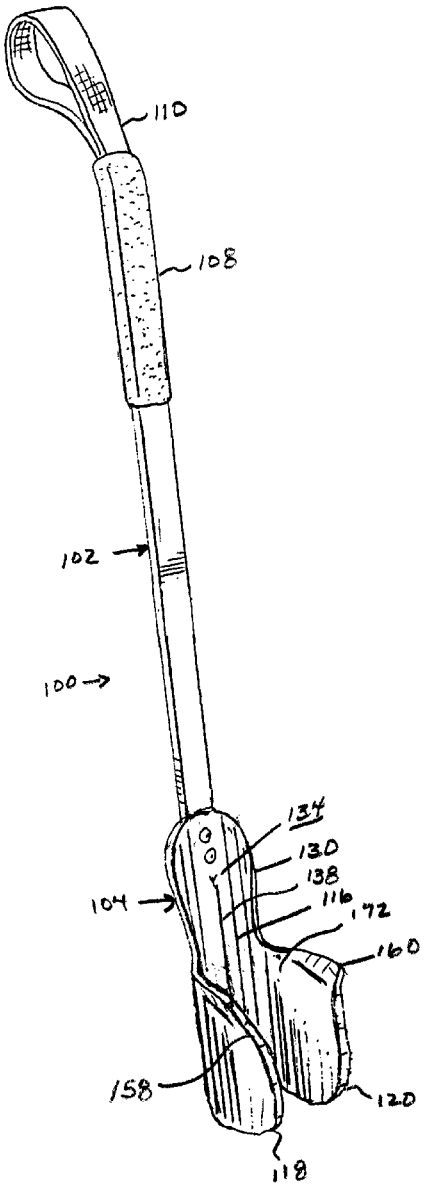
FIG. 1 is a perspective view of the footwear donning assistance device of this invention.

Comprehension of the present invention can be gained through reference to the drawings in conjunction with a thorough review of the following explanation. In order to facilitate a full appreciation of the invention, an overview of an exemplary embodiment is initially provided. The overview is followed by a more detailed explanation.

The device of this invention assists physically challenged persons when donning footwear. The device consists of a positioning member, such as a handle or strap, used to grasp the device and an insertion member. The insertion member may be resilient and flexible and include a lower dimension which is accommodated by an opening in footwear, the footwear opening being where a foot is inserted when the footwear is being donned. The insertion member may also include an upper portion, the upper portion including a pair of oppositely disposed wing-like (collar) guides (or braces) to provide support for the inside walls of the shoe and a guide when the person's foot is being inserted therein.

Referring particularly to FIGS. 1–4, a first embodiment of the footwear donning assistance device of this invention is depicted generally at 100. Device 100 broadly includes a positioning member such as a handle 102 and an insertion member 104. The handle 102 is constructed from a durable, lightweight plastic material such as polyurethane or polyvinylchloride in this embodiment. However, materials such as wood or any other substance providing the necessary strength and desired degree of flexibility are contemplated to be within the scope of this invention. In this embodiment, the handle 102 is between about 18" and 24" in length, about ⅞" in width, and is about ⅜" thick. However, other dimensions are contemplated to be useful to persons utilizing this invention, hence are within the scope of this invention as well.

The handle 102 may include a grasping aid such as a grip 108. The grip 108 in this embodiment is made from materials such as foam tubing. However, other materials constructed and dimensioned to provide an easier, more secure and/or a more comfortable grip to the person using the device of this invention may be used in making the grip 108 as well. The exemplary handle 102 further includes a grasping aid (positioning member) such as a strap or web 110, which may be looped as depicted. The strap 110 is present to allow the footwear donning assistance device 100 to be easily and readily secured by being looped around a user's wrist; conveniently stored by being looped around a peg or the like; and/or to assist the user when grasping the device. The strap 110 may further be configured to enable the user to simply hang the device on a receptacle such as a coat hook or other such fixture when the device is not in use. Other grasping aids may be present in lieu of the strap 100. These include features such as a curved or crooked end, or a handle extending generally perpendicularly, or otherwise transversely, from the handle 102.

The insertion member 104 may be made from flexible, substantially light weight and resilient materials, the materials flexing to accommodate the user's foot, but providing support to the shoe and holding components of the shoe firmly in place during use. Such materials may include synthetic resins such as polyvinylchloride or polyurethane and/or paper products. At least one portion of the exemplary insertion member may be generally C-shaped in cross section. In this embodiment, the insertion member 104 is substantially unitary, but may be considered to include a central element 116 and wing elements 118 and 120. In this embodiment, the wing elements 118 and 120 extend generally perpendicularly, or otherwise transversely, from the central element 116.

The central element 116 displays respective inner and outer surfaces 122 and 123 and has a lower rim 124. The lower rim 124 defines a generally central notch 126 with an apex 127 and notch borders 128 and 129. The central element 116 may also be considered to include an upper extension 130. A rim 132 of the upper extension 130 is rounded at its top and converges into the wing elements 118 and 120 at lower portions thereof. The upper extension 130 displays respective inner and outer surfaces 134 and 136. The inner surface 134 of the upper extension 130 generally presents a concave profile in lateral cross-section. The upper extension is widest at an upper portion thereof and tapers to converge with the wing elements 118 and 120. The tapering width of the present upper extension facilitates use by providing a wider surface 134 to receive a user's heel at the upper portion and by narrowing the surface 134 as the concavity of the surface 134 further guides the user's heel into the shoe during use. A crease 138 extends generally longitudinally between a central portion of the upper extension 130 and the apex 127. The crease 138 enhances the flexibility of the insertion member 104 by serving as an axis from which the insertion member 104 flexes to accommodate a user's inserted foot.

Each wing element 118 and 120 has a lower rim 144 and 146, respectively. The lower rims 144 and 146 are either curved or angled upwardly from the notch borders 128 and 129, respectively. The curved or angled lower rims 144 and 146 and the surfaces defined by the notch 126 allow the insertion member 104 to be tilted rearwardly during use without tilting the footwear piece being donned as well. Thus, the notch 176 and lower rims 144 and 146 of the wing elements 118 and 120 allow the insertion member 104 to be pivoted backward without pivoting the footwear when the present device has been inserted into a footwear piece.

Each wing element 118 and 120 displays respective inner surfaces 150 and 152 and outer surfaces 154 and 156. Respective upper portions 158 and 160 of the wing elements 118 and 120 flare outwardly and display inner surfaces 162 and 164 and outer surfaces 166 and 168. The wing elements 118 and 120 curve away from the central element 116.

The inner surfaces 122, 150, and 152 of the central element 116 and the wing elements 118 and 120 cooperate to define a channel 172. The channel 172 accommodates the user's foot when a piece of footwear is being donned using the present assistance device.

The concave upper extension 130 better guides the foot and heel of a user. The flared upper portions 158 and 160 also function to guide the user's foot when being inserted into channel 172 during use as well as ensuring that portions of the shoe are not rolled or folded inwardly or down by the user's foot when a footwear piece is being donned. In this embodiment, the handle 102 and insertion member 104 are attached by one or more fasteners such as the pop rivets 178. Of course, adhesives or other fastening means known to the art may be used as well.

Figure 5:
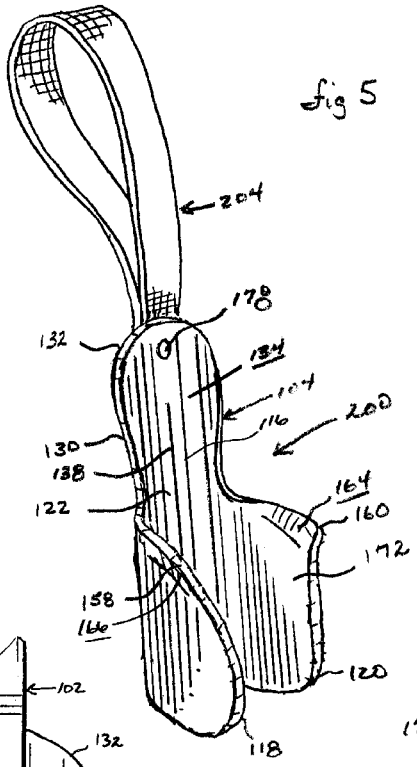
FIG. 5 is a perspective view of an alternate embodiment of the footwear donning assistance device of this invention.
Figure 3:
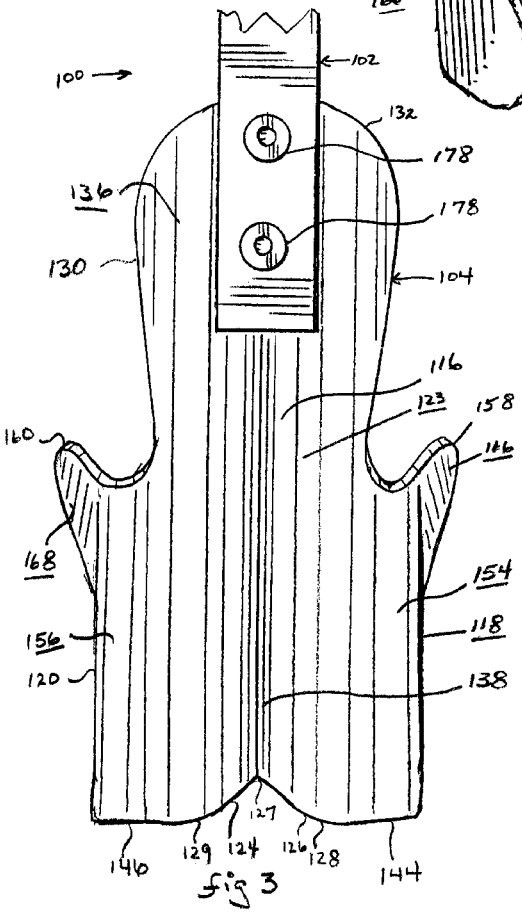
FIG. 3 is a fragmentary rear view of the insertion member of FIG. 1.
Figure 4:
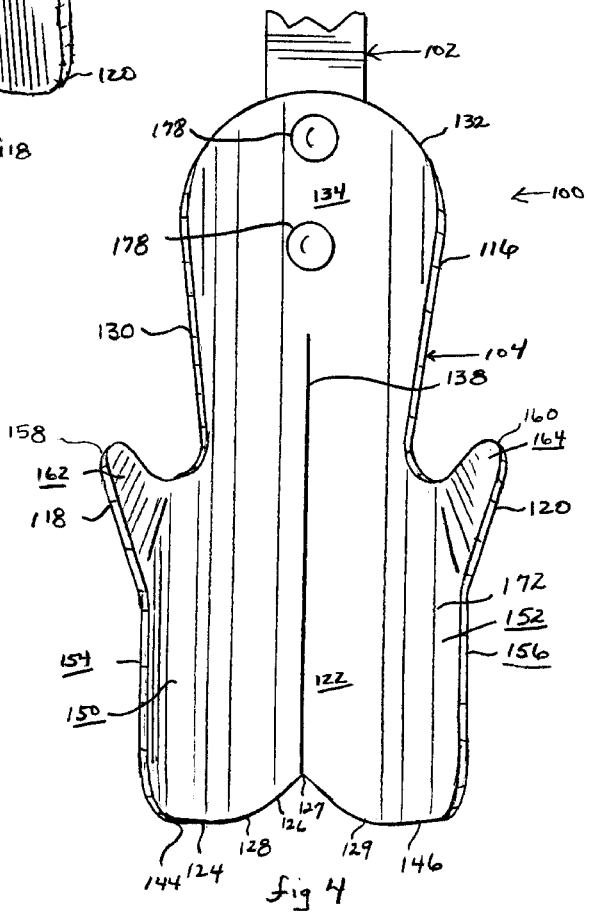
FIG. 4 is a fragmentary front view of the insertion member of FIG. 1.

Referring to FIG. 5, another embodiment of the present footwear donning assistance device is designated generally at 200 and differs from the embodiment described above mainly in that another positioning member such as a strap or web 204 is present in lieu of the handle 102.

Figure 6:
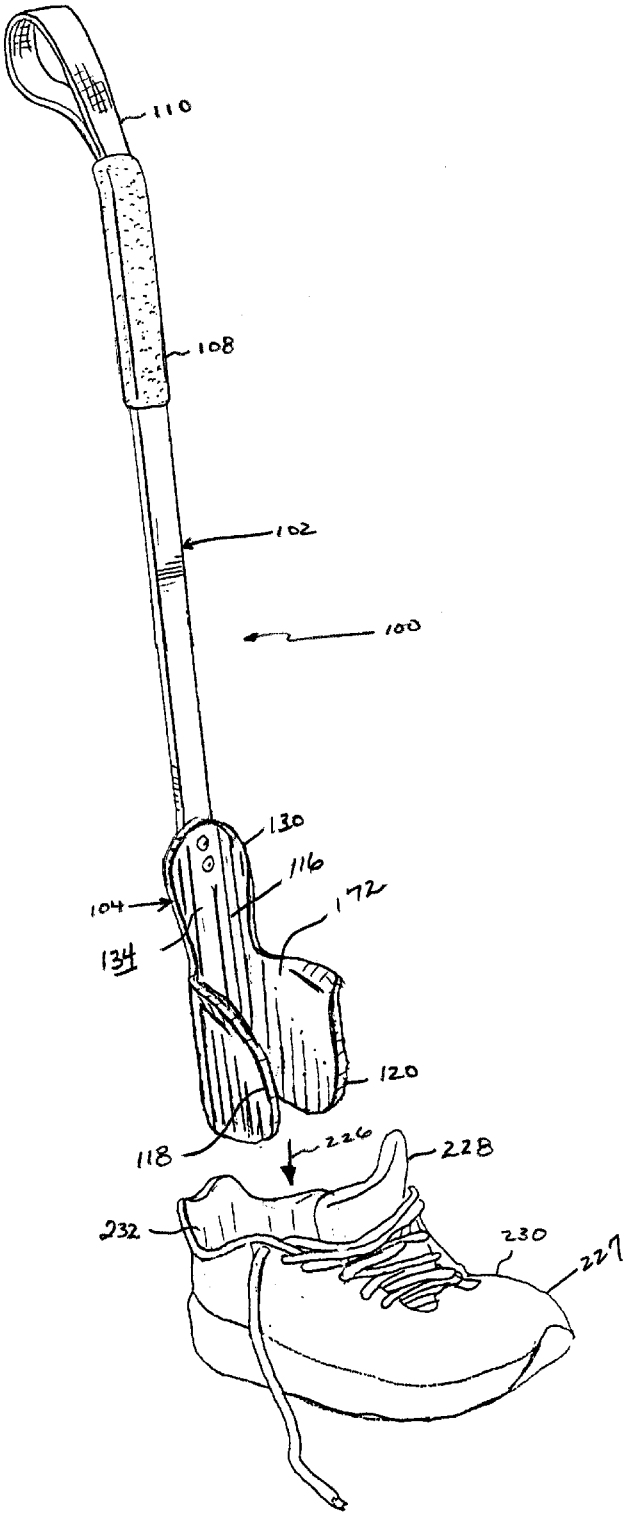
FIGS. 6–13 depict the embodiment of FIG. 4 being used to assist a user in donning a piece of footwear.
Figure 2:
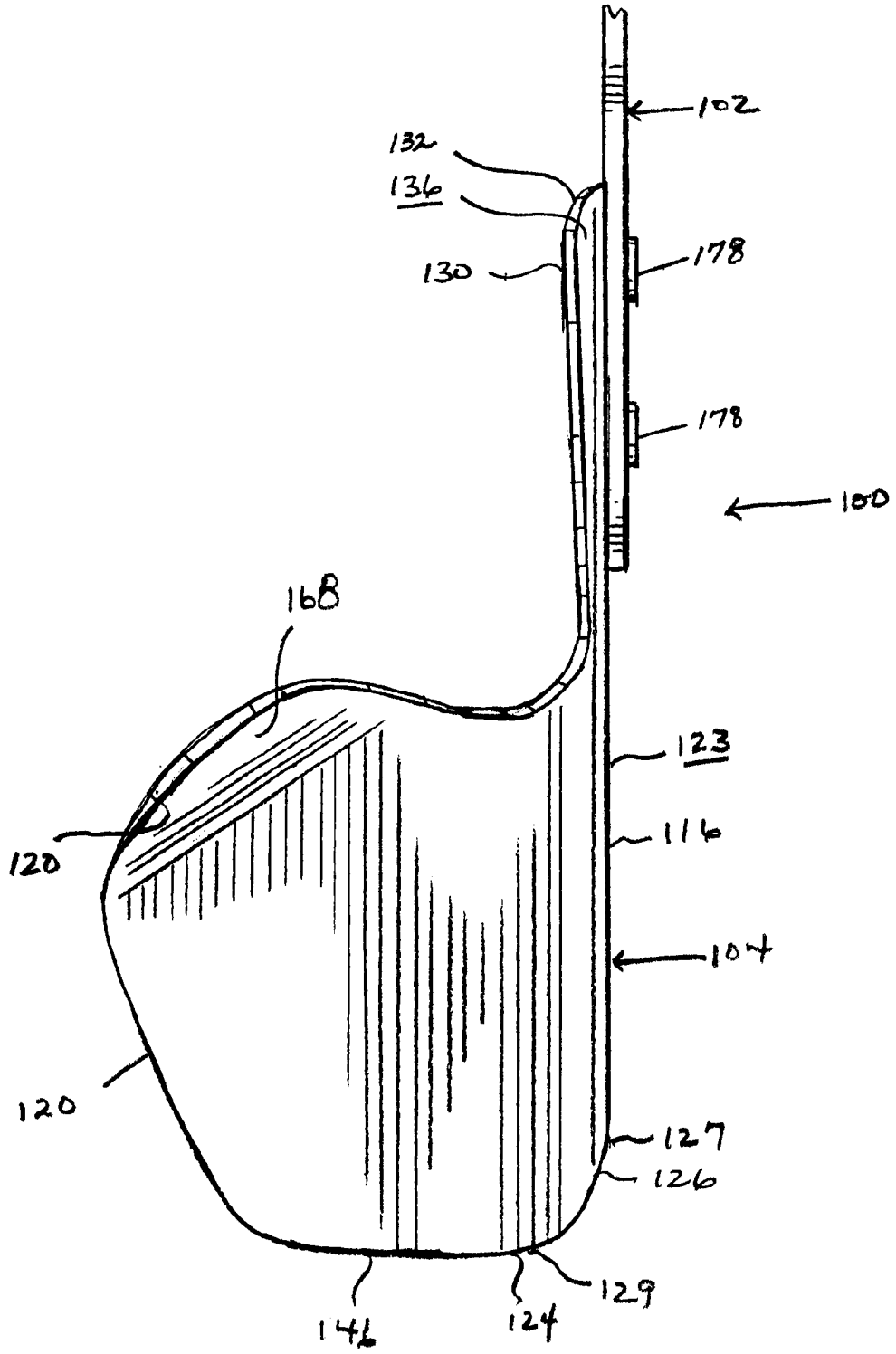
FIG. 2 is a fragmentary side view of the insertion member of FIG. 1.
Figure 7:
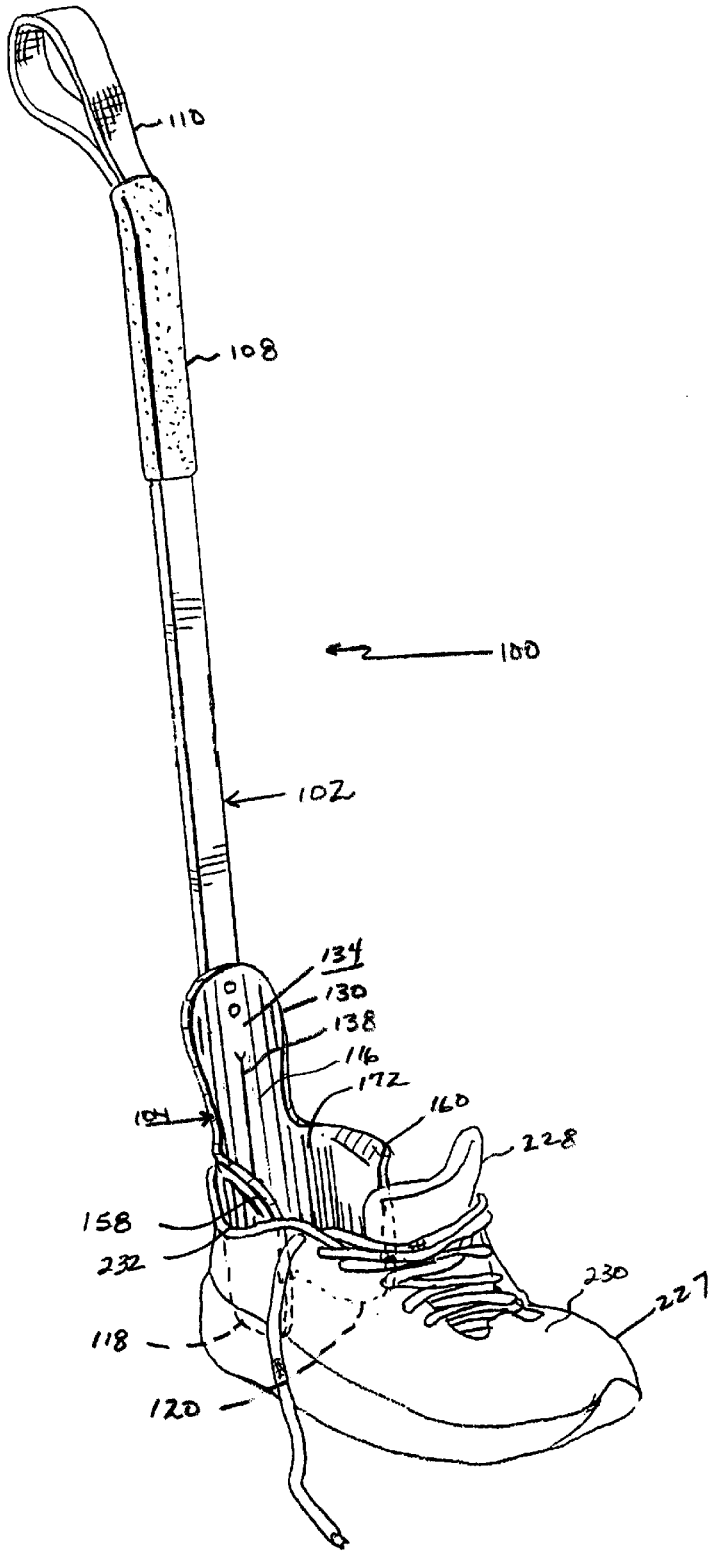
Figure 8:
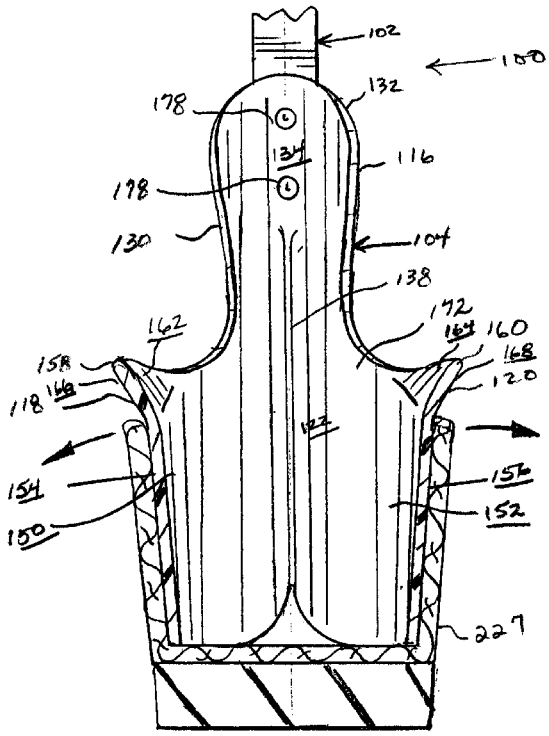

Referring to FIGS. 6–13, the device 100 assists a user in donning footwear in the following manner. In FIG. 6, the device 100 is lowered in the direction of arrow 226 until the insertion member 104 is inside the shoe 227 as shown in FIG. 7. If a tongue 228 is present, the tongue is arranged as shown to ensure that the user's foot does not push the tongue forward and under the shoe upper part 230 during insertion into the footwear piece. At this point the insertion member is disposed inside the shoe opening 232 (FIG. 8). The outer surfaces of the insertion member prevent the sides of the shoe from collapsing, folding, or rolling inwardly when the shoe is being donned. Moreover, the flared upper portions 158 and 160 face contracting portions of the shoe outward, to thereby guide and better allow insertion of the user's foot without rolling the upper shoe portions inwardly. The device 100 (or 200) can be pivoted back in the direction of arrow 234 without tipping the shoe backward, thereby to allow the insertion member to be tilted or angled as need during foot insertion. The ability of the present device to pivot without tending to tip the shoe is due, at least in part, to the presence of the notch 126 and the curvilinear, or angled, wing element lower rims. The crease 138 and the resilience, or flexibility, of the central element and the wing elements 118 and 120 allow the wing elements 118 and 120 to be displaced outwardly to accommodate the user's foot. However, these wing elements are sufficiently stiff to support the shoe sides and prevent them from being rolled or folded inwardly when the shoe is being donned in this manner.

Figure 9:
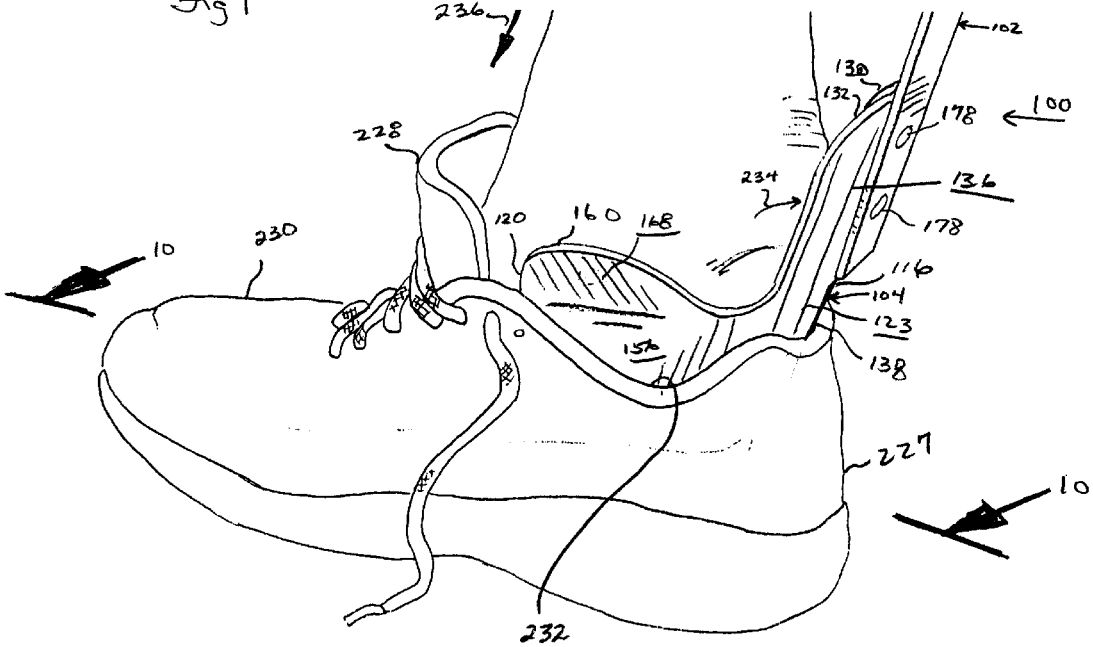
Figure 11:
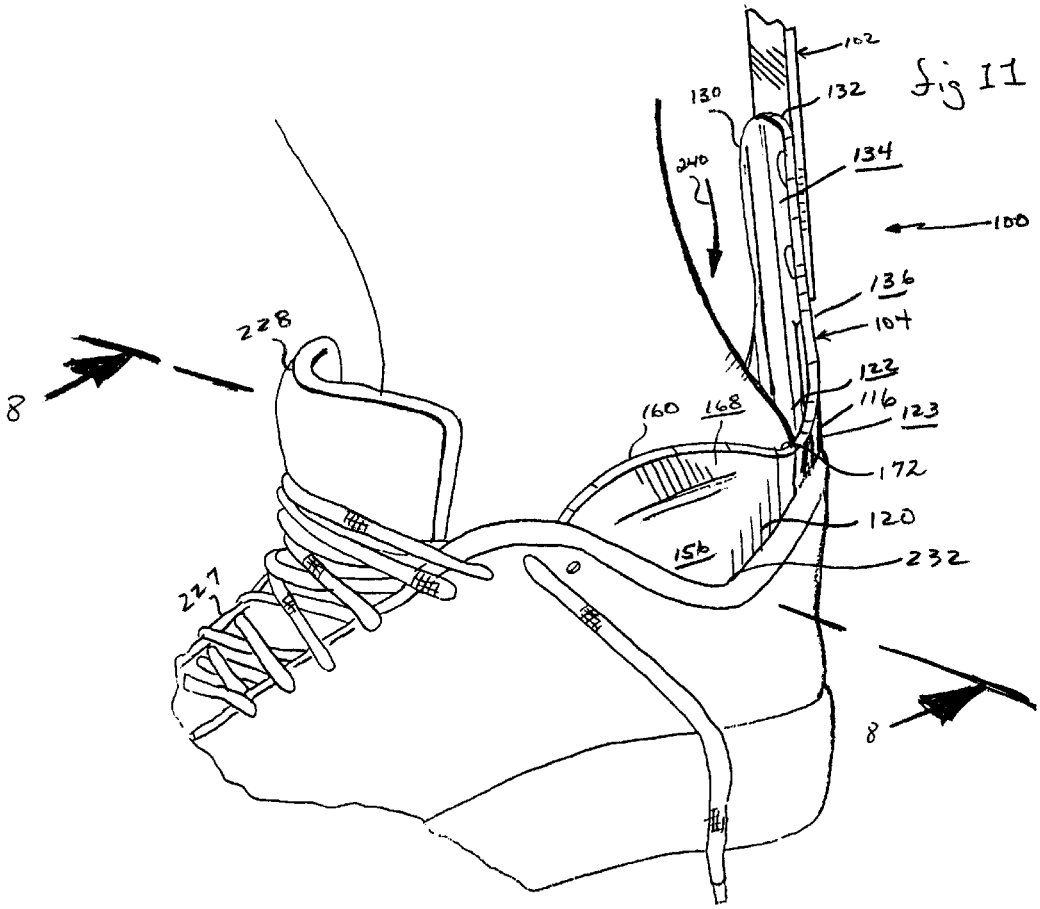
Figure 10:
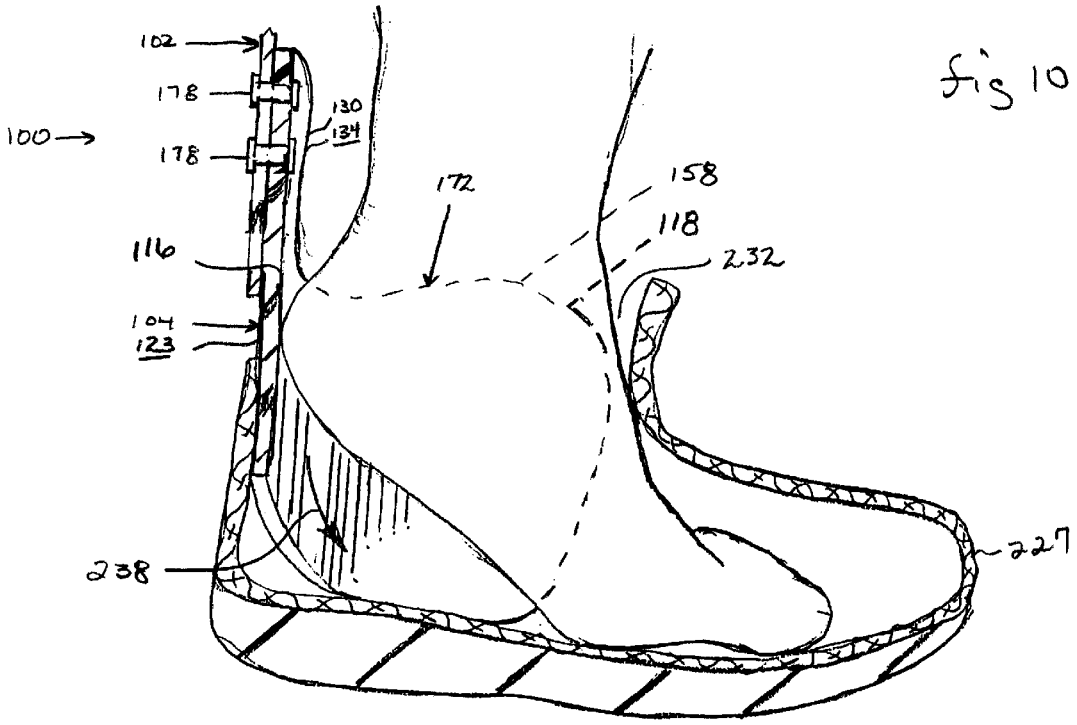

As shown in FIGS. 9 and 10, the user inserts the front of the user's foot into the channel 172 in the direction of arrows 236 and 238 and places the user's heel against inner surface 134 of the upper extension 130. The cross-sectionally concave contour of the inner surface 134 helps align and guide the user's heel into the heel of the shoe being donned. FIG. 11 depicts the user's heel being forced down in the direction of arrow 240 until the user's heel contacts the shoe inner sole as shown in FIG. 13.

Figure 13:
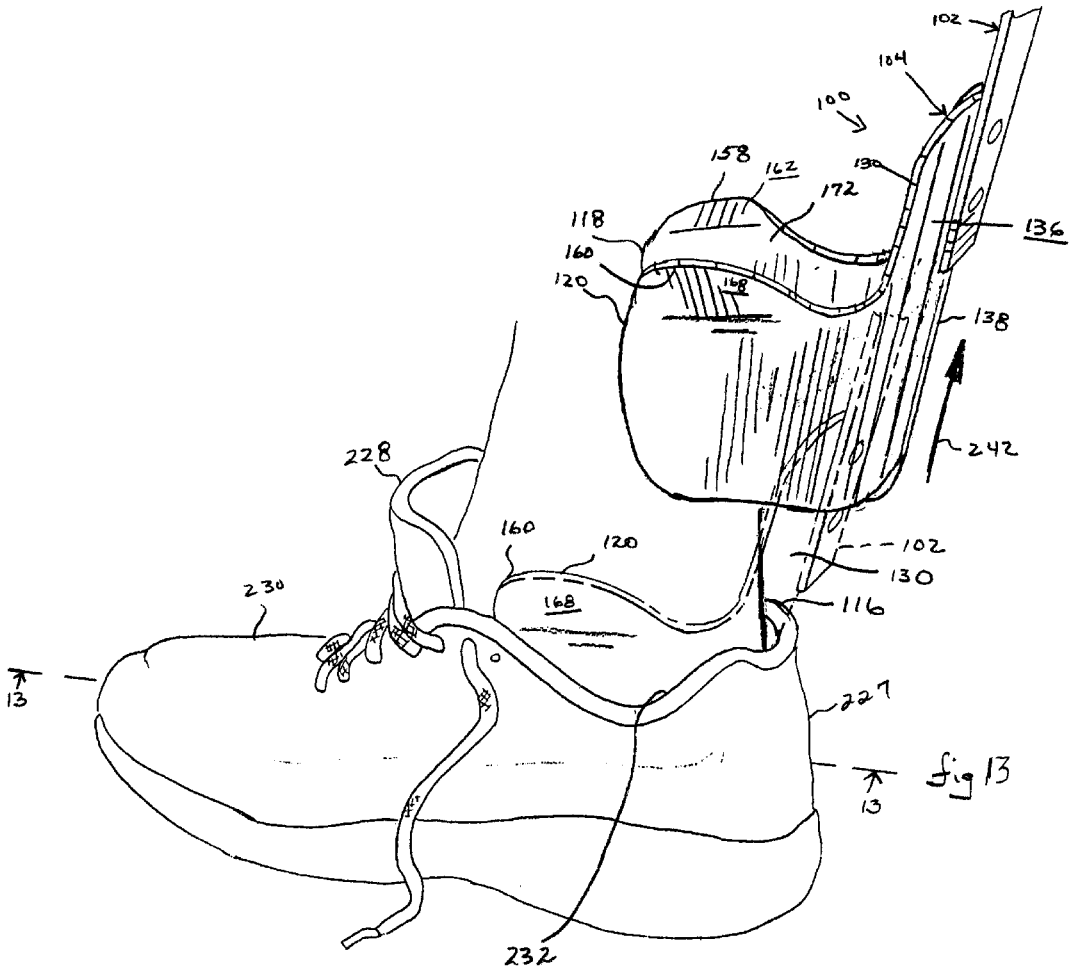
Figure 12:
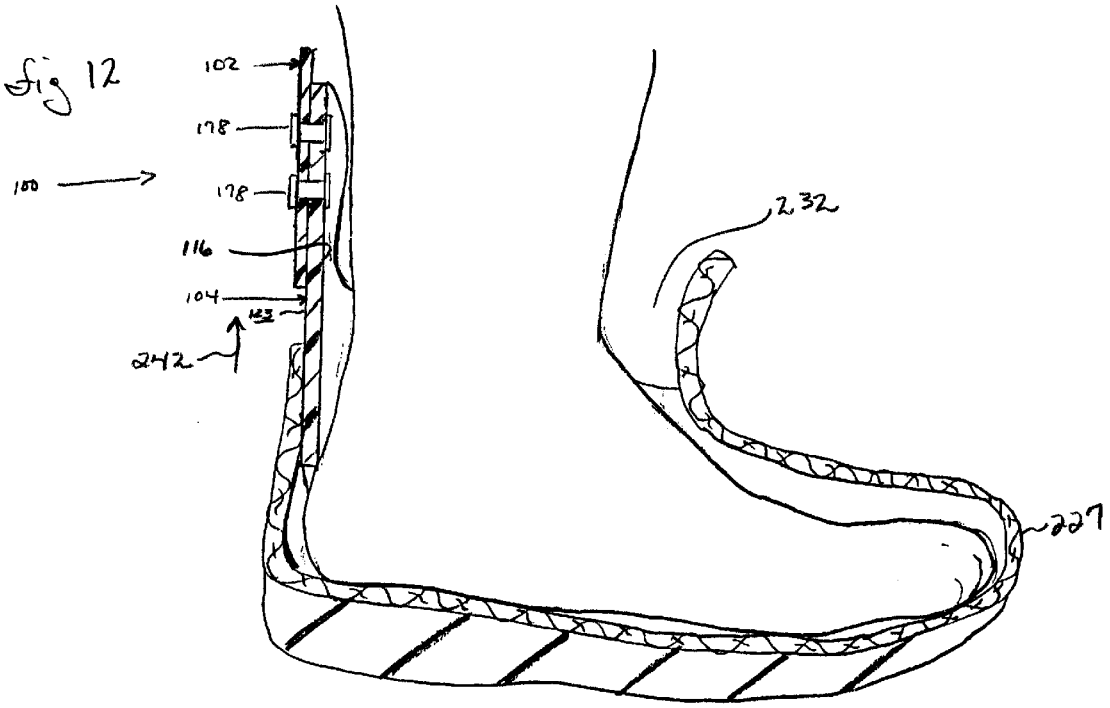

Once the user's foot is inside the shoe, the user pulls up on the handle 102 (or strap 204) in the direction indicated by arrow 242 to extract the insertion member from the shoe (FIGS. 12 and 13). The shoe has then been donned often without the user being required to bend over or adjust various parts of the shoe while the shoe is being donned.

Because numerous modifications may be made of this invention without departing from the spirit thereof, the scope of the invention is not to be limited to the embodiments described and illustrated.

What is claimed is:

1. A footwear donning assistance device, comprising:

a substantially resilient positioning member; and a substantially resilient insertion member generally C-shaped in cross-section and displaying a first end and a second end, the insertion member attached to the positioning member at the insertion member first end, the insertion member including a central element and first and second wing elements, each wing element including an upper, outwardly flared portion the central element and first and second wing elements displaying a lower rim at the insertion member second end, the lower rim including a generally central notch, the wing elements extending generally transversely from the central element, said first and second wing elements spaced apart to accommodate a user's foot therebetween and to spread and maintain the footwear proximate a footwear opening.

2. The device of claim 1, the central element lower rim further defining angled portions flanking the notch.

3. The device of claim 1, the central element lower rim defining curved portions flanking the notch.

4. The device of claim 1, the central element including a generally longitudinally extending crease.

5. The device of claim 1, the central element including an upper extension, the upper extension attached to the positioning member.

6. The device of claim 1, further comprising fasteners attaching the insertion member and the positioning member.

7. The device of claim 6, the fasteners comprising rivets.

8. The device of claim 1, the positioning member including first and second ends, the positioning member attached to the insertion member proximate the first end, the positioning member comprising a grip proximate the second end.

9. The device of claim 8, the positioning member further comprising a looped web attached proximate the handle.

10. The device of claim 1, the positioning member comprising a web.

11. The device of claim 10, in which the web is looped.

12. A method of making a device to assist a user in donning footwear, comprising:

forming a substantially resilient positioning member;

forming a substantially resilient insertion member generally C-shaped in cross-section and displaying a first end and a second end, the insertion member including a central element and first and second wing elements, each said wing element with an upwardly and outwardly flared portion, the wing elements extending generally transversely from the central element, the central element and first and second wing elements displaying a lower rim at the insertion member second end, the lower rim including a generally central notch, said first and second wing elements spaced apart to accommodate a user's foot therebetween and to spread and maintain the footwear proximate a footwear opening; and attaching the positioning member to the insertion member proximate the insertion member first end.

13. The method of claim 12, in which the positioning member and the insertion member are substantially unitary and in which the positioning member and the insertion member are attached when being formed simultaneously.

14. The method of claim 12, in which forming the insertion member includes forming a central element upper extension.

15. The method of claim 12, in which attaching the positioning member to the insertion member includes riveting the positioning member to the insertion member.

16. The method of claim 12, in which forming the positioning member includes forming a positioning member handle.

17. The method of claim 16, in which forming the positioning member includes positioning the handle on the positioning member.

18. The method of claim 12, in which forming the positioning member includes attaching a web to the positioning member.

19. The method of claim 12, in which forming the positioning member includes attaching a looped web to the positioning member.

20. A method of donning a footwear item, comprising:

providing a footwear donning assistance device, the device comprising a substantially resilient positioning member and a substantially resilient insertion member generally C-shaped in cross-section and displaying a first end and a second end, the insertion member attached to the positioning member at the insertion member first end, the insertion member including a central element and first and second wing elements, the wing elements extending from the central element and including an upper, outwardly flared portion, the central element and first and second wing elements displaying a lower rim at the insertion member second end, the lower rim including a generally central notch, said first and second wing elements spaced apart to accommodate a user's foot therebetween and to spread and maintain the footwear proximate a footwear opening;

positioning the insertion member in a footwear opening; and maneuvering a user's foot into the positioned insertion member such that the user's foot is in the footwear.

21. The method of claim 20, further comprising removing the insertion member from the footwear opening.

* * * * *